US012304759B1

(12) United States Patent
Wu et al.

(10) Patent No.: US 12,304,759 B1
(45) Date of Patent: May 20, 2025

(54) AUTOMATIC GRAPHITE CONVEYING DEVICE AND WINDING MACHINE FOR SPIRAL WOUND GASKET

(71) Applicant: GUANGZHOU DONGSHAN SOUTH SEALS COMPANY LTD., Guangdong (CN)

(72) Inventors: Kaijun Wu, Guangdong (CN); Shuji Wu, Guangdong (CN); Haiqiang Zhong, Guangdong (CN); Chulian Guan, Guangdong (CN)

(73) Assignee: GUANGZHOU DONGSHAN SOUTH SEALS COMPANY LTD., Guangdong (CN)

( * ) Notice: Subject to any disclaimer, the term of this patent is extended or adjusted under 35 U.S.C. 154(b) by 0 days.

(21) Appl. No.: 19/013,549

(22) Filed: Jan. 8, 2025

(30) Foreign Application Priority Data

Feb. 24, 2024 (CN) ..... 202410204624.9

(51) Int. Cl.
*B65H 18/08* (2006.01)
*B65H 54/04* (2006.01)

(52) U.S. Cl.
CPC ..... *B65H 18/08* (2013.01); *B65H 54/04* (2013.01); *B65H 2301/414323* (2013.01); *B65H 2701/17* (2013.01)

(58) Field of Classification Search
CPC ..... B65H 18/08; B65H 18/10; F16J 15/125
See application file for complete search history.

(56) References Cited

U.S. PATENT DOCUMENTS 2,579,858 A * 12/1951 Price ..... B21C 47/06 72/91
3,905,090 A * 9/1975 Painter ..... F16L 23/18 277/924
4,048,829 A * 9/1977 Thomas ..... B65H 81/06 29/455.1
6,823,579 B2 * 11/2004 Veiga ..... B65H 18/28 72/146
10,207,311 B2 * 2/2019 Barozzi ..... F16J 15/125

FOREIGN PATENT DOCUMENTS

CN 110203738 A * 9/2019 ..... B65H 19/30
CN 213737763 U * 7/2021
EP 0707906 A1 * 4/1996 ..... B21D 53/18

OTHER PUBLICATIONS

CN110203738A Description (Year: 2019).*
CN213737763UA Description (Year: 2021).*

* cited by examiner

*Primary Examiner* — Michael W Hotchkiss
(74) *Attorney, Agent, or Firm* — Cooper Legal Group, LLC

(57) ABSTRACT

An automatic graphite conveying device includes a mounting frame, a conveyor wheel, a first clamping wheel and a guide assembly, a gap is formed between the first clamping wheel and the guide assembly to convey a graphite strip, the mounting frame is configured with a mounting hole in a vertical direction for the graphite strip to pass through, the guide assembly includes a guide column and a second driver, the guide column is slidably mounted on the mounting frame, a guide plate is provided at an end of the guide column away from the mounting frame to guide the graphite strip to a winding machine for a spiral wound gasket, the mounting frame is slidably provided with a cutter, and a guide element with a guide hole is fixed on the mounting (Continued)

frame, and a cross-sectional area of the guide hole gradually decreases towards the mounting frame.

3 Claims, 4 Drawing Sheets

AUTOMATIC GRAPHITE CONVEYING DEVICE AND WINDING MACHINE FOR SPIRAL WOUND GASKET

CROSS-REFERENCE TO RELATED APPLICATION

This application claims the priority to Chinese patent application serial no. 202410204624.9, filed on Feb. 24, 2024. The entirety of Chinese patent application serial no. 202410204624.9 is hereby incorporated by reference herein and made a part of this specification.

TECHNICAL FIELD

The present application relates to the field of sealing gasket manufacturing, and more particularly, to an automatic graphite conveying device and a winding machine for a spiral wound gasket using same.

BACKGROUND ART

A graphite spiral wound gasket is a widely used sealing gasket, which is the most resilient gasket in semi-metal sealing gasket. It is composed of a common thin steel strip, a V-shaped thin steel strip or a W-shaped thin steel strip wound alternately with various graphite fillers, may resist high temperature and high pressure, and is suitable for use under ultra-low temperature or vacuum conditions. By changing the material combination of the gasket, the problem of chemical corrosion of the gasket by various media may be solved, and its structural density may be realized according to different locking force requirements.

By winding a conventional graphite spiral wound gasket, a graphite strip is manually placed adjacent the inner or outer ring of the gasket so that a machine may wind the graphite strip onto the inner or outer ring of the gasket. The cost of a manual placement is high, and the location of placement may deviate, resulting in more reworking and waste of materials.

SUMMARY

In order to facilitate a worker to transfer a graphite strip to a gasket to be wound during operation and to speed up the operation progress, the present application provides an automatic graphite conveying device and a winding machine for a spiral wound gasket using the same.

In a first aspect, the automatic graphite conveying device provided in the present application adopts the following technical solution.

An automatic graphite conveying device includes a mounting frame, a conveyor wheel, a first clamping wheel and a guide assembly, where the conveyor wheel and the first clamping wheel are both rotatably mounted on the mounting frame, the conveyor wheel and the first clamping wheel are oppositely arranged, a gap is formed between the conveyor wheel and the first clamping wheel to convey a graphite strip, and a first driver is mounted on the mounting frame to drive the conveyor wheel to rotate.

The mounting frame is configured with a mounting hole in a vertical direction configured for the graphite strip to pass through the mounting frame after passing through the gap, the guide assembly includes a guide column and a second driver, the guide column is slidably mounted on the mounting frame, the second driver is mounted on the mounting frame and is configured to drive the guide column to slide on the mounting frame, a guide plate is provided at an end of the guide column away from the mounting frame, and the guide plate is configured to guide the graphite strip passing out of the mounting frame to an input end of a winding machine for a spiral wound gasket in cooperation with the automatic graphite conveying device.

By using the above-mentioned technical solution, a worker, after adjusting the guide frame, retracts the guide frame towards the gasket machine, and then places the graphite strip between the first clamping wheel and the conveyor wheel, activates the first driver to drive the conveyor wheel to rotate, so that the graphite strip passes through the mounting hole. In addition, the graphite strip passing through the mounting hole abuts against the guide plate, and at this time, the second driver is activated to drive the guide column to slide on the mounting frame, thereby pushing the guide frame to slide relative to the mounting frame, so as to maintain the guide for the graphite strip, thereby transferring the graphite strip to the input end of the winding machine for the spiral wound gasket. Firstly, a telescopic guide frame is used to assist the movement of the graphite strip, which realizes a higher stability and accuracy, and reduces the deviation of the graphite strip, which is beneficial to reduce the loss caused by the deviation after manually placing the strip. Secondly, the first driver is used as a power source, the stable movement of the graphite strip is maintained, such that the graphite strip is less likely broken due to uneven stress during manual operation.

Optionally, the mounting frame is provided with a cutter between the mounting hole and the guide plate, the cutter is slidably mounted on the mounting frame in a direction perpendicular to a transport direction of the graphite strip at the mounting hole, and the mounting frame is provided with a third driver configured to drive the cutter to slide on the mounting frame.

By adopting the above-mentioned technical solution, after completing the winding of one gasket, the worker activates the third driver to drive the cutter to slide to cut the graphite strip, in this way, the graphite strip may be quickly and accurately cut, which facilitates the worker to start the winding of the next gasket.

Optionally, the first clamping wheel is slidably mounted on the mounting frame in a direction close to or away from the conveyor wheel, and the mounting frame is provided with a fourth driver configured to drive the first clamping wheel to slide.

By using the above-mentioned technical solution, before placing the graphite strip, the fourth driver is activated to slide the first clamping wheel in a direction away from the conveyor wheel, thereby enlarging the size of the gap, facilitating the worker to place the graphite strip in the gap and completing the preparation work for the graphite strip. After the graphite strip is placed, the fourth driver is again activated to drive the first clamping wheel to move along a direction close to the conveyor wheel to clamp the graphite strip, and at this time, the first driver is activated to start the conveyance of the graphite strip. The first clamping wheel, which is movable back and forth, is used to increase the speed at which the worker places the graphite strip while stably transferring the graphite strip, thereby increasing the production speed of the gasket.

Optionally, a guide element is fixed on the mounting frame at an input end of the gap, the guide element is configured with a guide hole, and a cross-sectional area of the guide hole gradually decreases towards the mounting frame.

When a new segment of graphite strip is manually placed into the gap, if the graphite strip is not aligned, it will easily break after collision with the conveying device, resulting in waste of raw materials. By using the above-mentioned technical solution, the worker puts the end of the graphite strip into the guide element, and the graphite strip is guided to the input end of the gap through the gradually reduced guide hole, so as to be transported by the conveyor wheel and the first clamping wheel, which reduces the waste generated by crushing the graphite strip after impact.

In a second aspect, the present application provides a winding machine for a spiral wound gasket in cooperation with the automatic graphite conveying device, which uses the following technical solution.

A winding machine for a spiral wound gasket includes a stander, a graphite tray, a rotary wheel, a welding wheel and a second clamping wheel, where the rotary wheel, the welding wheel and the second clamping wheel are all rotatably mounted on the stander, the rotary wheel is configured for mounting a gasket body, and the rotary wheel is configured to clamp the gasket body through a movement of the rotary wheel.

The gasket body is configured to be wound around by the graphite strip and a steel strip overlapping each other, the second clamping wheel is configured to abut against the gasket body on the rotary wheel, the welding wheel is configured to abut against the steel strip on the gasket body after being energized and to fix the steel strip by welding, the graphite tray is fixedly mounted on the stander, and the automatic graphite conveying device is mounted on the stander and configured to convey the graphite strip on the graphite tray to the gasket body on the rotary wheel.

By using the above-mentioned technical solution, the worker firstly locks a gasket body on the rotary wheel, and then pulls the graphite strip from the graphite tray and places the same on the automatic graphite conveying device. After the steel strip is wound around the gasket body, the conveying device is started to convey the graphite strip to the gasket body, the winding operation is started, and the steel strip is welded on the gasket body using the welding wheel, thereby completing the winding of the gasket. The worker may quickly and accurately transfer the graphite strip to the gasket body using the winding machine for the spiral wound gasket with the graphite conveying device, which reduces the rework caused by the deviation of graphite strip transfer, thereby reducing the waste of materials, which is beneficial to reducing the production cost of the factory.

Optionally, the stander is respectively provided with a storage rack at each of two sides of a rotary shaft of the rotary wheel in the vertical direction, the two storage racks extend in a length direction of the rotary shaft of the rotary wheel, a plurality of gasket bodies are slidably mounted between the two storage racks, the plurality of gasket bodies are arranged along the length direction of the rotary shaft of the rotary wheel and are sleeved on the rotary shaft of the rotary wheel, and each of the two storage racks is provided with a limiting assembly for limiting the plurality of gasket bodies.

By using the above-mentioned technical solution, a plurality of gasket bodies are placed between the storage racks and are limited by the limiting assembly. When the operation of the previous gasket is completed, a worker only needs to release the limit of the limiting assembly on the gasket body, take out the gasket body therefrom and places the same on the rotary wheel to start the winding work. After completing the operation of the gasket body, the gasket body is removed in the direction away from the stander, and the next gasket body is taken out from the storage racks in a direction close to the stander for operation. This material storage method may effectively reduce the time of picking up materials during operation, which is beneficial to speed up operation and reduce manpower consumption.

Optionally, the limiting assembly includes a first stop block and a second stop block, each of the two storage racks is configured with a first sliding groove and a second sliding groove, the first stop block is slidably mounted on a respective one of the two storage racks in a length direction of the two storage racks through the first sliding groove, the second stop block is slidably mounted on an end of the respective one of the two storage racks away from the stander in a direction perpendicular to the length direction of the two storage racks through the second sliding groove, an end of the second stop block facing radially an inner side surface of the respective one of the two storage racks is provided with an elastic member, each of two sides of the second stop block in the length direction of the two storage racks is respectively configured with a first guide surface, the plurality of gasket bodies are mounted between the first stop block and the second stop block, a fifth driver is provided on a side of the first stop block away from the second stop block, and the fifth driver is configured to drive the first stop block to slide.

By using the above-mentioned technical solution, when charging the storage racks, a plurality of gasket bodies are sleeved on the rotary wheel, the second stop block is pushed into the storage rack via the first guide surface, and at the same time, a fifth driver is started to drive the first stop block to slide in a direction away from the second stop block, so as to conveniently place the gasket bodies in the storage racks, and at this time, the second stop block protrudes out of the storage rack due to the action of the elastic member and abuts against the gasket bodies, so as to limit the gasket bodies together with the first stop block. When taking the material, the fifth driver is activated to drive the first stop block to slide on the storage rack to push the gasket bodies to move on the storage rack, so that the gasket body located at the outermost side moves to the rotary wheel after the second stop block is lifted via the first guide surface, and the worker uses the rotary wheel to fix the gasket body to perform the winding operation, which greatly reduces the labor cost of the worker when charging, and accelerates the operation.

Optionally, a second guide surface is configured on an outer periphery of the rotary wheel along a circumferential direction of the rotary wheel, the second guide surface directly faces the two storage racks and abuts against one of the plurality of gasket bodies on a side of the second stop block away from the first stop block, and the rotary wheel is configured with a slot for handling in the circumferential direction on a side of the second guide surface away from the stander.

By using the above-mentioned technical solution, when the gasket body located at the outermost side passes over the second stop block and then stops on the upper and lower storage racks, the worker activates the rotary wheel, and the wheel body of the rotary wheel moves in a direction away from the rotary shaft, thereby pushing the gasket body on the storage racks into the slot for handling via the second guide surface to fix the same, which saves the procedure of clamping the gasket body on the rotary wheel, thereby increasing the speed of performing the winding operation.

Optionally, the stander is provided with a steel strip tray, the stander is further provided with a guide frame between the steel strip tray and the rotary wheel, a guide sleeve is slidably mounted inside the guide frame, a sixth driver is fixedly mounted outside the guide frame for driving the guide sleeve to slide on the guide frame, and the guide sleeve is sleeved over the steel strip and directly faces the rotary wheel.

When the gasket body of a larger size is processed, the distance between the end of the steel strip and the rotary wheel is too large, which makes it difficult for the steel strip to align with the gasket body, requiring the assistance of a worker. By using the above-mentioned technical solution, the sixth driver is activated to drive the guide sleeve to slide on the guide frame, thereby guiding the steel strip passing through the guide sleeve to the rotary wheel.

In summary, the present application includes at least one of the following beneficial technical effects:

1. Firstly, a telescopic guide frame is used to assist the movement of the graphite strip, which realizes a higher stability and accuracy, and reduces the deviation of the graphite strip, which is beneficial to reduce the loss caused by the deviation after manually placing the strip. Secondly, the first driver is used as a power source, the stable movement of the graphite strip is maintained, such that the graphite strip is less likely broken due to uneven stress during manual operation.

2. The worker puts the end of the graphite strip into the guide element, and the graphite strip is guided to the input end of the gap through the gradually reduced guide hole to be transported by the conveyor wheel and the first clamping wheel, which reduces the waste generated by crushing the graphite strip after impact.

DETAILED DESCRIPTION

This application is described in further detail below referring to FIGS. 1-5.

Figure 1:
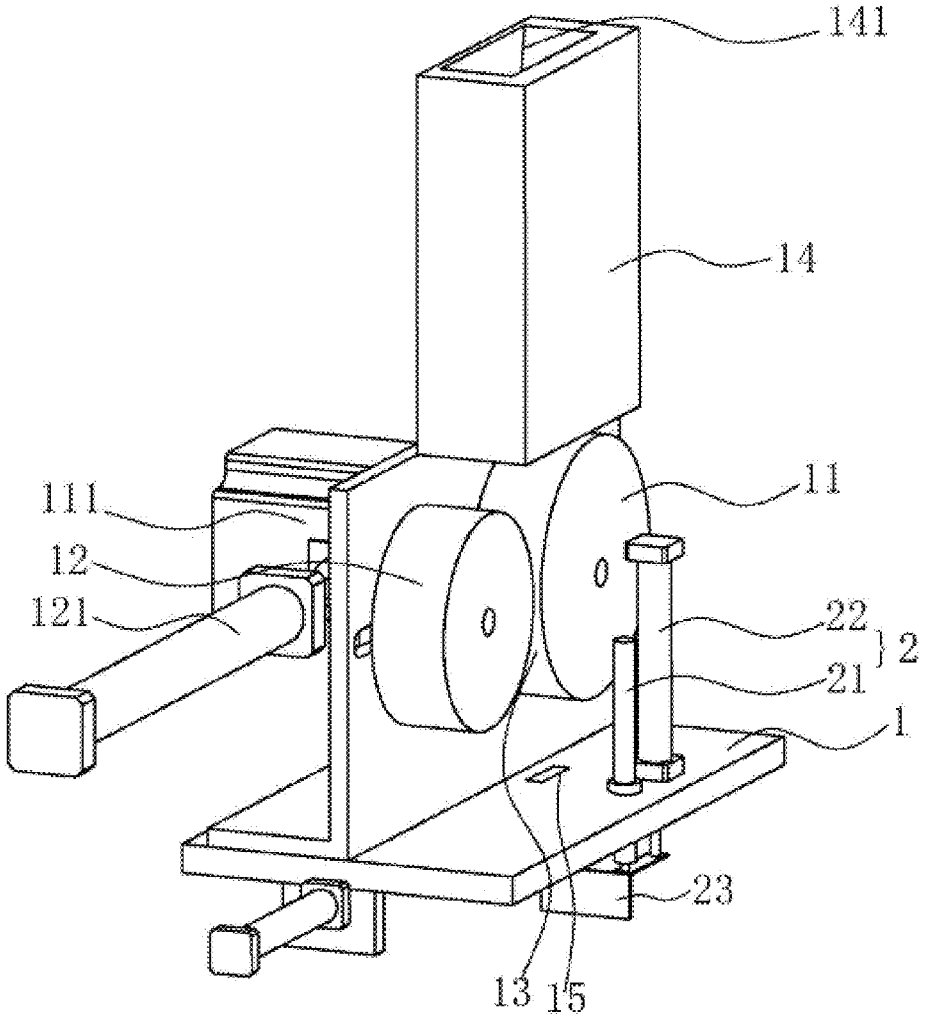
FIG. 1 is an overall schematic structural diagram showing an automatic conveying device according to an embodiment of the present application.
Figure 2:
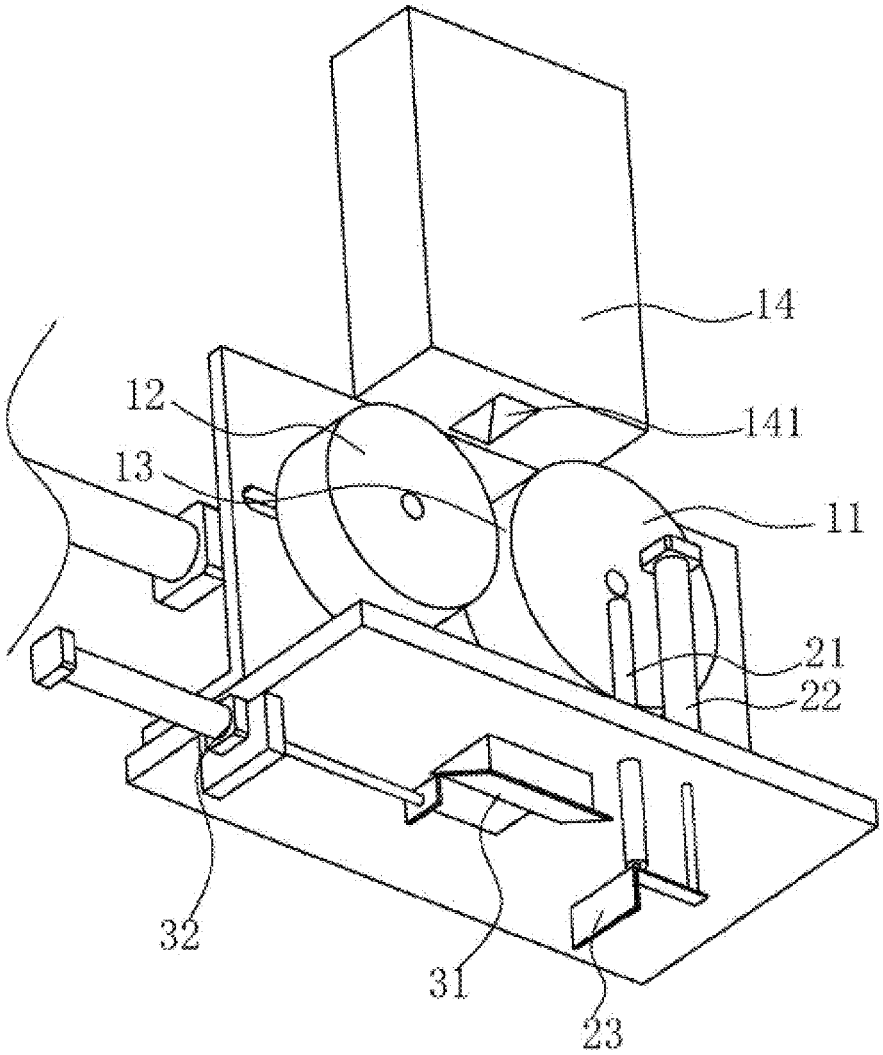
FIG. 2 is an overall schematic structural diagram showing the automatic conveying device according to an embodiment of the present application from the bottom.

Embodiments of the present application disclose an automatic graphite conveying device. Referring to FIGS. 1 and 2, the automatic graphite conveying device includes a mounting frame 1, a conveyor wheel 11, a first clamping wheel 12, and a guide assembly 2. The conveyor wheel 11 and the first clamping wheel 12 are both rotatably mounted on the mounting frame 1, the conveyor wheel 11 and the first clamping wheel 12 rotate relative to each other on the same plane and a gap 13 for conveying the graphite strip 46 is formed between the outer peripheries of the both. The mounting frame 1 is provided with a first driver 111 for driving the conveyor wheel 11 to rotate. In the present embodiment, the first driver 111 is a motor fixedly mounted on the mounting frame 1, and the conveyor wheel 11 is fixedly connected to the output end of the first driver 111. The first clamping wheel 12 is slidably mounted on the mounting frame 1 in a direction toward or away from the conveyor wheel 11, and a fourth driver 121 for driving the first clamping wheel 12 to slide is mounted on the mounting frame 1. In the present embodiment, the fourth driver 121 is a cylinder, the fourth driver 121 is fixedly mounted on the mounting frame 1, and a piston rod of the fourth driver 121 is fixedly connected to the first clamping wheel 12.

A guide element 14 is fixedly mounted on the mounting frame 1 at an input end of the gap 13 and is provided with a guide hole 141, and the cross-sectional area of the guide hole 141 gradually decreases towards the mounting frame 1. A worker places the end of the graphite strip 46 into the guide element 14, and the graphite strip 46 extends into the guide element 14 and out of the tapered guide hole 141, so as to stably extend into the gap 13. At this time, the worker may activate the fourth driver 121 to drive the first clamping wheel 12 to slide to stably clamp the graphite strip 46 with the conveyor wheel 11, thereby transporting the graphite strip 46.

The mounting frame 1 is configured with a mounting hole 15 through which the graphite strip 46 passes through the gap 13 in a vertical direction. The guide assembly 2 includes a guide column 21 slidably mounted on the mounting frame 1 and a second driver 22 on the mounting frame 1 for driving the guide column 21 to slide on the mounting frame 1. In the present embodiment, the second driver 22 is a cylinder, the piston rod of the second driver 22 is fixedly connected to the guide column 21, and a guide plate 23 is provided at an end of the guide column 21 out of the mounting frame 1 at the bottom, and the guide plate 23 is configured for guiding a graphite strip 46 out of the mounting frame 1 to cooperate with an input end of the gasket machine of the conveying device. A side of the guide plate 23 away from the guide column 21 directly faces the input end of the gasket machine. After passing through the gap 13, the graphite strip 46 passes through the mounting hole 15 and reaches the bottom of the mounting frame 1 and abuts against the guide plate 23. The worker starts the second driver 22 at this time to drive the guide column 21 to slide, so as to move the guide plate 23 towards the raw material input end of the gasket machine, and meanwhile, the conveyor wheel 11 together with the first clamping wheel 12 convey the graphite strip 46, so that the guide plate 23 and the graphite strip 46 move synchronously, so as to accurately convey the graphite strip 46 to the input end of the gasket machine along a sliding direction of the guide column 21.

Referring to FIG. 2, the mounting frame 1 is provided with a cutter 31 between the mounting hole 15 and the guide plate 23, and the cutter 31 is slidably mounted on the mounting frame 1 along a direction perpendicular to the transport direction of the graphite strip 46 at the mounting hole 15. The mounting frame 1 is provided with a third driver 32 for driving the cutter 31 to slide on the mounting frame 1, the third driver 32 is a cylinder and is fixedly mounted on the mounting frame 1, and a piston rod of the third driver 32 is fixedly connected to the cutter 31. The graphite strip 46 may be quickly cut off by the cutter 31, so that the worker may handle the next gasket.

The implementation principle of the automatic graphite conveying device in the embodiments of the present application is as follows. A worker first puts the graphite strip 46 into the guide element 14, after the graphite strip is in place, the first driver 111 is activated to drive the conveyor wheel 11 to rotate, so that the graphite strip stably passes through the mounting hole 15 and moves to the guide plate 23 under the clamping of the first clamping wheel 12, and the second driver 22 is activated to drive the guide plate 23 to slide, so as to accurately convey the graphite coil fitting tightly to the guide plate 23 to the gasket machine.

When the winding operation of one gasket is completed, the third driver 32 is activated to drive the cutter 31 to slide on the mounting frame 1, so as to cut the graphite strip 46, and the worker applies the next segment of the graphite strip 46 to the next gasket.

Figure 3:
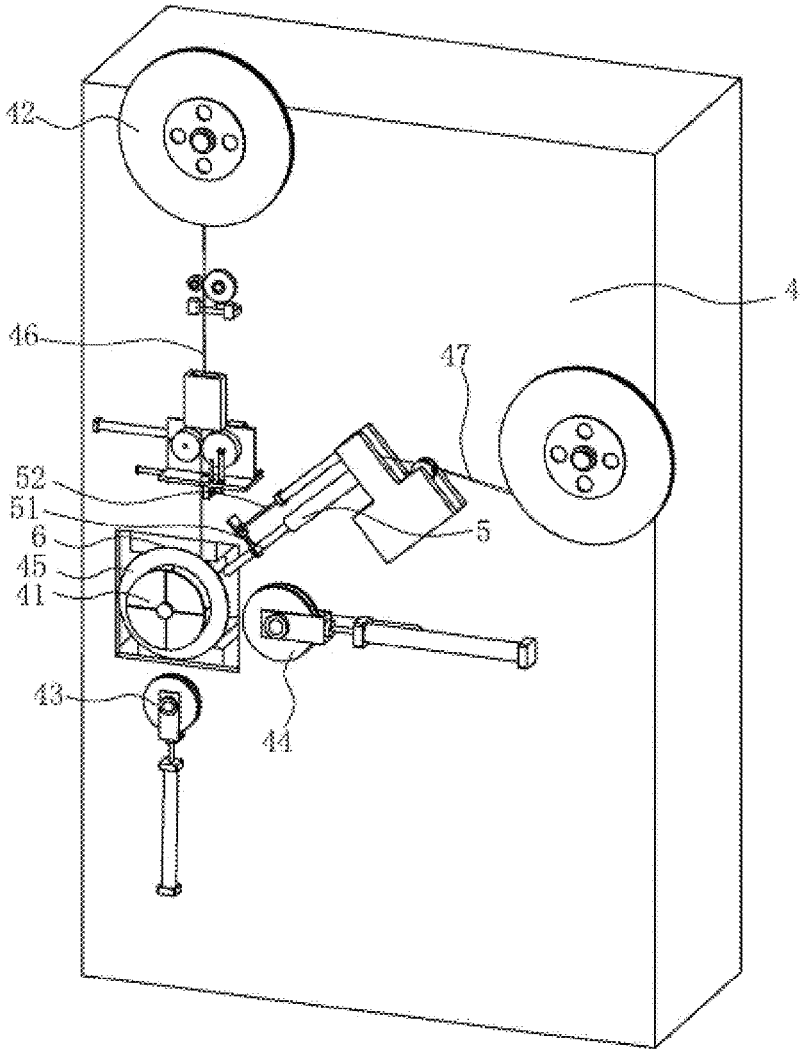
FIG. 3 is an overall schematic structural diagram showing a winding machine for a spiral wound gasket.

The embodiments of the present application also disclose a winding machine for a spiral wound gasket, and referring to FIG. 3, the winding machine for the spiral wound gasket includes a stander 4, a graphite tray 42, a rotary wheel 41, a welding wheel 43 and a second clamping wheel 44. The rotary wheel 41, the welding wheel 43 and the second clamping wheel 44 are all rotatably mounted on the stander 4. The rotary wheel 41 is used for mounting a gasket body 45, and the rotary wheel 41 clamps the gasket body 45 by the movement of the wheel body.

The graphite strip 46 and a steel strip 47 overlapping each other are wound around the gasket body 45, and the second clamping wheel 44 abuts against the steel strip 47 on the gasket body 45 on the rotary wheel 41. The welding wheel 43 is energized, then abuts against the steel strip 47 wound around the gasket body 45 and fixes the steel strip 47 by welding. The graphite tray 42 is fixedly mounted on the stander 4, and the conveying device is mounted on the stander 4 for conveying the graphite strip 46 on the graphite tray 42 to the gasket body 45 on the rotary wheel 41.

Referring to FIG. 3, a steel strip tray is mounted on the stander 4. The stander 4 is fixedly provided with a guide frame 5 between the steel strip tray and the rotary wheel 41, a guide sleeve 51 is slidably mounted inside the guide frame 5, and a sixth driver 52 for driving the guide sleeve 51 to slide on the guide frame 5 is fixedly mounted outside the guide frame 5. In the present embodiment, the sixth driver 52 is a cylinder, and a piston rod of the sixth driver 52 is fixedly connected to the guide sleeve 51. The steel strip 47 passes through the guide sleeve 51 and directly faces the rotary wheel 41, and the steel strip 47 is accurately transported to the gasket body 45 by the slidable guide sleeve 51.

Before winding the graphite strip 46 and the steel strip 47 around the gasket body 45, the worker takes out the graphite strip 46 from the graphite tray 42 and places the graphite strip 46 on the conveying device while taking out the steel strip 47 from the steel strip tray and winding it around the gasket body 45 through the guide sleeve 51, and then presses the gasket body 45 against the steel strip 47 with the welding wheel 43 to weld the steel strip 47 onto the gasket body 45. The worker then activates the conveying device to convey the graphite strip 46 to the gasket body 45 and co-wind with the steel strip 47 around the gasket body 45, and continues to weld the steel strip 47 to fix the graphite strip 46.

Figure 4:
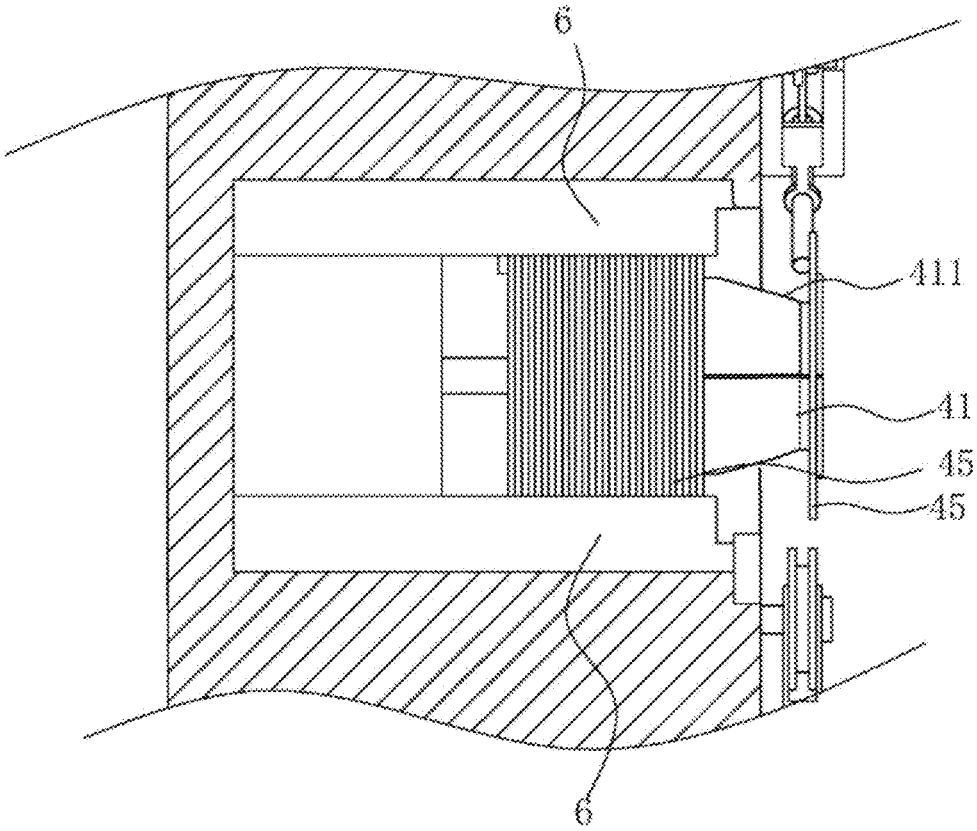
FIG. 4 is a sectional view showing a state, in which a gasket body of the winding machine for the spiral wound gasket is mounted on the storage racks.
Figure 5:
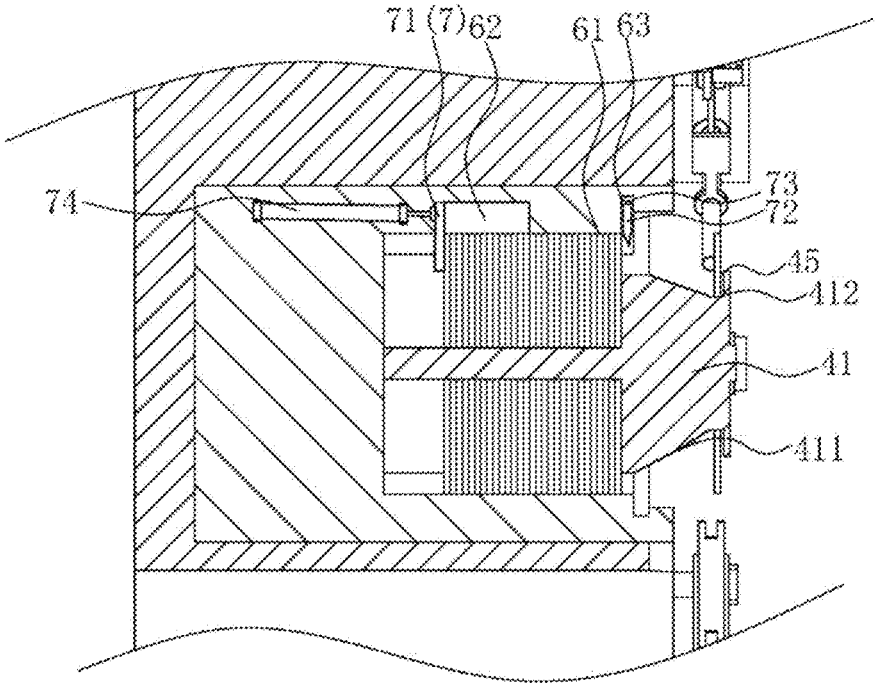
FIG. 5 is a sectional view of a gasket body of a winding machine for the spiral wound gasket mounted on the storage racks.

Referring to FIGS. 4 and 5, the stander 4 is provided with storage racks 6 at two sides in a vertical direction at a rotary shaft of the rotary wheel 41, and each storage rack 6 extends along a length direction of the rotary shaft of the rotary wheel 41. Several gasket bodies 45 are slidably mounted between two storage racks 6, and sides of the storage racks 6 close to each other are each configured with a holding groove 61 adapted to the gasket body 45. The holding groove 61 has an arc shape, and an inner arc surface of the holding groove 61 is configured to abut against the gasket bodies 45. Several gasket bodies 45 are arranged along the length direction of the rotary shaft of the rotary wheel 41 and are sleeved over the rotary shaft of the rotary wheel 41. The storage rack 6 is provided with a limiting assembly 7 for limiting the gasket body 45.

The limiting assembly 7 includes a first stop block 71 and a second stop block 72, and the storage rack 6 is configured with a first sliding groove 62 and a second sliding groove 63. The first stop block 71 is slidably mounted on the storage rack 6 along a length direction of the storage rack 6 through the first sliding groove 62, and the second stop block 72 is slidably mounted at an end of the storage rack 6 away from the stander 4 along a direction perpendicular to the length direction of the storage rack 6 through the second sliding groove 63. The end of the second stop block 72 facing a radially inner side of the storage rack 6 is provided with an elastic member 73 which in the present embodiment is a spring. One end of the elastic member 73 is sleeved over the second stop block 72, while the other end thereof is fixed at the groove bottom of the second sliding groove 63. The second stop block 72 is provided with a first guide surface at each of the two sides thereof along the length direction of the storage rack 6. Each gasket body 45 is mounted between the first stop block 71 and the second stop block 72. A fifth driver 74 is provided on a side of the first stop block 71 away from the second stop block 72 for driving the first stop block 71 to slide. In the present embodiment, the fifth driver 74 is a cylinder and is fixedly mounted on the storage rack 6, and the piston rod thereof is connected to the first stop block 71.

Referring to FIG. 4, a second guide surface 411 is configured on an outer periphery of the rotary wheel 41 along a circumferential direction thereof, and the second guide surface 411 directly faces the storage racks 6 and abuts against the gasket body 45 on a side of the second stop block 72 away from the first stop block 71. The rotary wheel 41 is configured with a slot for handling 412 along the circumferential direction thereof at a side of the second guide surface 411 away from the stander 4.

Before the winding operation of the gasket body 45 is started, a plurality of gasket bodies 45 are sleeved over the rotary wheel 41 and clamped between the two storage racks 6, and at this time, the fifth driver 74 drives the first stop block 71 to move toward the stander 4 until a predetermined number of gasket bodies 45 are filled between the two storage racks 6.

When the winding operation of the gasket body 45 is started, the fifth driver 74 is activated to drive the first stop block 71 to slide in the storage racks 6 until abutting against the innermost gasket body 45, so as to push the gasket bodies 45 to move until the outermost gasket body 45 abuts against the second stop block 72. After being pushed, the outermost gasket body 45 pushes the second stop block 72 to slide into the second sliding groove 63 via the first guide surface, and thus the outermost gasket body 45 may slide onto the second guide surface 411 on the rotary wheel 41 after passing the position where the second stop block 72 is located, and at this time, the worker activates the rotary wheel 41, so that the wheel body moves in a direction away from the stander 4, thereby enabling the outermost gasket body 45 to slide in a direction away from the stander 4 via the second guide surface 411 after abutting against the second guide surface 411. After the gasket body 45 is moved to the slot for handling 412, the gasket body 45 is sleeved on the rotary wheel 41, thereby enabling the worker to perform a winding process on the gasket body 45, which reduces the labor cost required for the worker to take a new gasket body 45 and improves the automation of the winding machine for the spiral wound gasket.

Referring to FIG. 3, the stander 4 is provided with a mounting base between the graphite tray 42 and the conveyor, and a photoelectric sensor, a laser transmitter and an alarming device are provided on the mounting base. When the graphite strip 46 is transferred between the photosensor and the laser transmitter, the laser light is blocked, so that the photosensor may not sense the laser light, and no alarm is sent out. When there is no graphite strip 46 between the photosensor and the laser transmitter, the photosensor senses the laser light from the laser transmitter and triggers the alarming device to generate an alarm.

The above-mentioned preferred embodiments of the present application do not limit the protection scope of the present application, and therefore: all equivalent variations in the structure, shape, and principles of the present application are intended to be within the scope of the present application.

LIST OF REFERENCE SIGNS

1 mounting frame
11 conveyor wheel
111 first driver
12 first clamping wheel
121 fourth driver
13 gap
14 guide element
141 guide hole
15 mounting hole
2 guide assembly
21 guide column
22 second driver
23 guide plate
31 cutter
32 third driver
4 stander
41 rotary wheel
411 second guide surface
412 slot for handling
42 graphite tray
43 welding wheel
44 second clamping wheel
45 gasket body
46 graphite strip
47 steel strip
5 guide frame
51 guide sleeve
52 sixth driver
6 storage rack
61 holding groove
62 first sliding groove
63 second sliding groove
7 limiting assembly
71 first stop block
72 second stop block
73 elastic member
74 fifth driver

What is claimed is:

1. An automatic graphite conveying device, comprising a mounting frame, a conveyor wheel, a first clamping wheel and a guide assembly, wherein the conveyor wheel and the first clamping wheel are both rotatably mounted on the mounting frame, the conveyor wheel and the first clamping wheel are oppositely arranged, a gap is formed between the conveyor wheel and the first clamping wheel to convey a graphite strip, and a first driver is mounted on the mounting frame to drive the conveyor wheel to rotate, the mounting frame is configured with a mounting hole in a vertical direction configured for the graphite strip to pass through the mounting frame after passing through the gap, the guide assembly comprises a guide column and a second driver, the guide column is slidably mounted on the mounting frame, the second driver is mounted on the mounting frame and is configured to drive the guide column to slide on the mounting frame, a guide plate is provided at an end of the guide column away from the mounting frame, and the guide plate is configured to guide the graphite strip passing out of the mounting frame to an input end of a winding machine for a spiral wound gasket in cooperation with the automatic graphite conveying device, the mounting frame is provided with a cutter between the mounting hole and the guide plate, the cutter is slidably mounted on the mounting frame in a direction perpendicular to a transport direction of the graphite strip at the mounting hole, and the mounting frame is provided with a third driver configured to drive the cutter to slide on the mounting frame, the first clamping wheel is slidably mounted on the mounting frame in a direction close to or away from the conveyor wheel, and the mounting frame is provided with a fourth driver configured to drive the first clamping wheel to slide, and a guide element is fixed on the mounting frame at an input end of the gap, the guide element is configured with a guide hole, and a cross-sectional area of the guide hole gradually decreases towards the mounting frame.

2. A winding machine for a spiral wound gasket in cooperation with the automatic graphite conveying device according to claim 1, comprising a stander, a graphite tray, a rotary wheel, a welding wheel and a second clamping wheel, wherein the rotary wheel, the welding wheel and the second clamping wheel are all rotatably mounted on the stander, the rotary wheel is configured for mounting a gasket body, and the rotary wheel is configured to clamp the gasket body through a movement of the rotary wheel, the gasket body is configured to be wound around by the graphite strip and a steel strip overlapping each other, the second clamping wheel is configured to abut against the gasket body on the rotary wheel, the welding wheel is configured to abut against the steel strip on the gasket body after being energized and to fix the steel strip by welding, the graphite tray is fixedly mounted on the stander, and the automatic graphite conveying device is mounted on the stander and configured to convey the graphite strip on the graphite tray to the gasket body on the rotary wheel, the stander is respectively provided with a storage rack at each of two sides of a rotary shaft of the rotary wheel in the vertical direction, the two storage racks extend in a length direction of the rotary shaft of the rotary wheel, a plurality of gasket bodies are slidably mounted between the two storage racks, the plurality of gasket bodies are arranged along the length direction of the rotary shaft of the rotary wheel and are sleeved on the rotary shaft of the rotary wheel, and each of the two storage racks is provided with a limiting assembly for limiting the plurality of gasket bodies, the limiting assembly comprises a first stop block and a second stop block, each of the two storage racks is configured with a first sliding groove and a second sliding groove, the first stop block is slidably mounted on a respective one of the two storage racks in a length direction of the two storage racks through the first sliding groove, the second stop block is slidably mounted on an end of the respective one of the two storage racks away from the stander in a direction perpendicular to the length direction of the two storage racks through the second sliding groove, an end of the second stop block facing a radially inner side surface of the respective one of the two storage racks is provided with an elastic member, each of two sides of the second stop block in the length direction of the two storage racks is configured with a first guide surface, the plurality of gasket bodies are mounted between the first stop block and the second stop block, a fifth driver is provided on a side of the first stop block away from the second stop block, and the fifth driver is configured to drive the first stop block to slide, and a second guide surface is configured on an outer periphery of the rotary wheel along a circumferential direction of the rotary wheel, the second guide surface directly faces the two storage racks and abuts against one of the plurality of gasket bodies on a side of the second stop block away from the first stop block, and the rotary wheel is configured with a slot for handling in the circumferential direction on a side of the second guide surface away from the stander.

3. The winding machine for the spiral wound gasket according to claim 2, wherein the stander is provided with a steel strip tray, the stander is further fixedly provided with a guide frame between the steel strip tray and the rotary wheel, a guide sleeve is slidably mounted inside the guide frame, a sixth driver is fixedly mounted outside the guide frame for driving the guide sleeve to slide on the guide frame, and the guide sleeve is sleeved over the steel strip and directly faces the rotary wheel.

* * * * *